US011111722B2

(12) United States Patent
Haapalahti

(10) Patent No.: US 11,111,722 B2
(45) Date of Patent: Sep. 7, 2021

(54) END PIECE FOR A SUNSHADE'S EDGE RAIL AND SUNSHADE

(71) Applicant: Suomen Visor Oy, Kempele (FI)

(72) Inventor: Teuvo Haapalahti, Oulunsalo (FI)

(73) Assignee: Suomen Visor Oy, Kempele (FI)

( * ) Notice: Subject to any disclaimer, the term of this patent is extended or adjusted under 35 U.S.C. 154(b) by 287 days.

(21) Appl. No.: 16/286,677

(22) Filed: Feb. 27, 2019

(65) Prior Publication Data

US 2019/0264500 A1 Aug. 29, 2019

(30) Foreign Application Priority Data

Feb. 27, 2018 (FI) ..... 20185180

(51) Int. Cl.
*E06B 9/32* (2006.01)
*E06B 9/388* (2006.01)
*E06B 9/58* (2006.01)

(52) U.S. Cl.
CPC ..... *E06B 9/32* (2013.01); *E06B 9/388* (2013.01); *E06B 2009/583* (2013.01)

(58) Field of Classification Search
CPC ..... E06B 2009/583; E06B 2009/2625; E06B 2009/2627; E06B 9/32; E06B 9/327; E06B 9/38; E06B 9/388
See application file for complete search history.

(56) References Cited

U.S. PATENT DOCUMENTS 2,555,848 A * 6/1951 Ehret ..... E06B 9/58 160/279
2,572,847 A * 10/1951 Ehret ..... E06B 9/58 160/279
4,473,101 A * 9/1984 Langeler ..... E06B 9/32 160/279
4,557,309 A * 12/1985 Judkins ..... E06B 9/262 160/279

(Continued)

FOREIGN PATENT DOCUMENTS

JP S63 184683 A 7/1988
JP H07166777 A 6/1995

(Continued)

OTHER PUBLICATIONS

European Patent Office, search report of European patent application No. EP19159395.3, dated Jul. 3, 2019, 3 pages.

(Continued)

*Primary Examiner* — Johnnie A. Shablack
(74) *Attorney, Agent, or Firm* — Thomas|Horstemeyer LLP

(57) ABSTRACT

The end piece of sunshade's edge rail comprises an end plate, which includes a first edge surface, a second edge surface and a first end surface. The end plate further includes a second end surface, which is to be placed against an end of the edge rail and which has at least one gripping protrusion adaptable to fit inside the edge rail. The end plate is further provided with a first hole for the penetration of a guiding string. The end piece is further provided with a (Continued)

string channel, which includes a first end opening onto the first edge surface and a second end opening onto the second edge surface. The first hole opens into the string channel. A guiding string included in the sunshade can be extended into the first hole by way of the string channel.

10 Claims, 2 Drawing Sheets

(56) References Cited

U.S. PATENT DOCUMENTS

| | | | | | |
|---|---|---|---|---|---|
| 4,687,041 | A * | 8/1987 | Anderson | E06B 9/32 | 160/168.1 R |
| 4,733,710 | A * | 3/1988 | Haines | B60J 1/2091 | 160/107 |
| 4,733,711 | A * | 3/1988 | Schon | E06B 9/262 | 160/279 |
| 4,762,159 | A * | 8/1988 | Ford | E06B 9/262 | 160/279 |
| 4,825,929 | A | 5/1989 | Haines | | |
| 4,842,034 | A | 6/1989 | Haines | | |
| 6,044,889 | A * | 4/2000 | Liu | E06B 9/327 | 160/172 R |
| 6,119,755 | A * | 9/2000 | Oskam | E06B 9/262 | 160/84.02 |
| 6,918,425 | B2 * | 7/2005 | Nien | E06B 9/322 | 160/172 R |
| 6,929,049 | B2 * | 8/2005 | Nicolosi | E06B 9/264 | 160/107 |
| 7,191,817 | B2 * | 3/2007 | Nicolosi | E06B 9/264 | 160/84.06 |
| 7,546,866 | B2 * | 6/2009 | Strand | E06B 9/262 | 160/171 |
| 9,206,639 | B2 * | 12/2015 | Chen | E06B 9/262 | |
| 9,637,973 | B1 * | 5/2017 | Berman | E06B 9/327 | |
| 10,145,171 | B2 * | 12/2018 | Anderson | E06B 9/30 | |
| 10,641,038 | B2 * | 5/2020 | Franssen | E06B 9/388 | |
| 10,781,634 | B2 * | 9/2020 | Campagna | E06B 9/42 | |
| 2019/0264500 | A1 * | 8/2019 | Haapalahti | E06B 9/388 | |

FOREIGN PATENT DOCUMENTS

| | | |
|---|---|---|
| JP | H08 013956 A | 1/1996 |
| JP | H08 291674 A | 11/1996 |

OTHER PUBLICATIONS

Finnish Patent and Registration Office, Search Report of Finnish Patent Application No. 20185180, 1 page.

* cited by examiner

END PIECE FOR A SUNSHADE'S EDGE RAIL AND SUNSHADE

PRIORITY

This application claims priority of Finnish patent application number 20185180 filed on Feb. 27, 2018, the content of which is incorporated herein by reference.

FIELD OF THE INVENTION

The invention relates to an end piece for a sunshade's edge rail, said end piece comprising an end plate, said end plate having a first edge surface, a second edge surface, a first end surface, and a second end surface to be placed against an end of the edge rail, said second end surface having at least one gripping protrusion adaptable to fit inside the edge rail, and said end plate having a first hole for the penetration of a guiding string. The invention relates further to a sunshade.

BACKGROUND

Windows, glass opening doors, and balcony glasses are often provided with sunshades to restrict the access of solar radiation into room spaces or a balcony. Generally, the sunshades are either venetian blinds or so-called pleated blinds, featuring a folding protective screen which has its top edge provided with a first edge rail and its bottom edge with a second edge rail. The edge rails can be moved along guiding strings co-directional with the edges of an opening, thereby changing a shade-giving surface area of the protective screen between the edge rails. The edge rails are generally aluminum profiles, which include one or more cavities lengthwise of the edge rail and which are closed at the ends thereof with plastic end pieces.

The number of guiding strings is generally at least two, such that the first guiding string is fixed to a first edge of the protective screen and the second guiding string to a second edge of the protective screen. The guiding strings are attached by a first end thereof to a first end side of the opening to be covered and by second end thereof to a second end side of the opening to be covered. The guiding strings may extend co-directionally with horizontal edges of the opening to be covered or co-directionally with vertical edges of the opening. The guiding strings support the protective screen by its edges and sustain the protective screen in a substantially single plane, in other words prevent deflection of the protective screen. As the width of a protective screen increases, the screen's mid-section is often provided with installed support strings which are tasked to support and guide a protective screen also at the protective screen's mid-section. Support strings are needed especially in pleated blinds intended for balcony glasses and in blinds mounted on doors, which are often exposed to wind pressure and airflow. One pleated blind as described above is disclosed in publication JPH07166777.

In order for guiding strings to cover as little as possible of a window, door or balcony glass opening or a doorway, the guiding strings are often adapted to extend in the closest possible proximity to the side edges of an opening to be draped. Such guiding strings are conducted through the end piece of a first edge rail into the edge rail's interior, wherein the string first runs over a short distance co-directionally with the edge rail, makes a right-angle turn towards a second edge rail and proceeds through holes in the pleats of a protective screen co-directionally with a side edge of the opening to be draped into the second edge rail's interior. In the second edge rail, the guiding string's passage continues by way of a hole in the second edge rail's end piece outside of the edge rail, wherein it deflects again to extend alongside a side edge of the opening to be draped. The support strings of wide pleated blinds are conducted to extend into edge rails and out of edge rails through holes in the end piece in a substantially identical manner.

In publication U.S. Pat. No. 4,825,929 A is described an end piece for a sunshade's edge rail, comprising an end plate with a first and a second edge surface, a first and a second end surface, as well as a hole for the penetration of a guiding string. The second end surface carries a gripping protrusion adaptable inside the edge rail.

A problem with the foregoing pleated blinds is that the guiding strings extending by way of the edge rails' end pieces are not capable of preventing rotation of the edge rails around the longitudinal axes thereof as the edge rails are moved by manual force. The unintentional rotation of edge rails while moving the same hampers the operation of a guiding string mechanism and causes extra friction that accelerates wear of the guiding strings.

Another problem with pleated blinds is that the passage line of guiding strings must have its bend points inside the edge rails installed with support sleeves used for preventing wear of the guiding strings. Installation of the support sleeves and threading the guiding strings therethrough increases the manufacturing time of pleated blinds.

SUMMARY OF THE INVENTION

It is an objective of the invention to introduce an end piece for a sunshade's edge rail and a sunshade, which enable elimination of problems associated with the prior art and especially with pleated blinds. The objectives according to the invention are attained with an end piece and a sunshade, which are characterized by what is presented in the independent claims. A few preferred embodiments of the invention are presented in the dependent claims.

The invention relates to an end piece intended for a sunshade's edge rail and provided with an end plate. The end plate features a first edge surface, a second edge surface, and a first end surface. The end plate further features a second end surface to be placed against an end of the edge rail, said second end surface being provided with at least one gripping protrusion adaptable to fit inside the edge rail. The end plate is further provided with a first hole for the penetration of a guiding string. The end piece further includes a string channel, said string channel having a width, a first end which opens onto the first edge surface, and a second end which opens onto the second edge surface. The first hole opens into the string channel. It is by virtue of the string channel that the guiding string included in a sunshade can be extended to the first hole by way of the string channel.

In one preferred embodiment for an end piece of the invention, between the string channel and the first end surface is provided a wall, said wall including a through-going groove. The groove has its first end at a first end of the string channel and its second end at a second end of the string channel. The groove has a width which is substantially less than the width of the string channel. The groove enables a guiding string to be placed in the string channel via the groove through the wall, in other words the guiding string need not be threaded into the string channel by way of the string channel's ends. The groove's width can be dimensioned to be substantially equal to that of the guiding string.

In a second preferred embodiment for an end piece of the invention, the wall is provided with a through-going aperture, said aperture having a width exceeding the width of the groove and said aperture being in alignment with the first hole. The aperture facilitates threading of the guiding string into the first hole.

In a third preferred embodiment for an end piece of the invention, the groove has a section between its first end and its second end provided with at least one bend, in other words, the groove is not straight over its entire length. In a sunshade installed in place, the guiding strings are always in a taut condition, in other words, extending in a straight line. The bend included in the groove hinders the undesired departure of a straight-lined guiding string from the string channel by way of the groove. Preferably, said bend in the groove is in alignment with the aperture included in the wall.

In yet another preferred embodiment for en end piece of the invention, the first hole has a first penetrating direction and the end piece has a first gripping protrusion, said first gripping protrusion having a through-going string opening, said string opening having a second penetrating direction. The second penetrating direction is substantially perpendicular to the first penetrating direction and the string opening is located at a distance from the first hole. The penetrating direction represents here a center line direction of the hole or the opening.

In a still further preferred embodiment for an end piece of the invention, the end plate is further provided with a second hole for the penetration of a string. The second hole opens into the string channel and the end piece is further provided with a second gripping protrusion, such that the second hole opens alongside or extends through the second gripping protrusion. The second hole can be used for passage through the end piece of other strings included in the sunshade operating mechanism.

The sunshade according to the invention comprises a first guiding string, a protective screen with said protective screen having an edge, and an edge rail at the edge of the protective screen. The edge rail has a first end and a second end, said ends being provided with an end piece. The end pieces are end pieces consistent with the foregoing description.

In one preferred embodiment for a sunshade of the invention, the first guiding string is adapted to extend by way of a string channel, a first hole and a string opening included in an end piece present at a first end of the edge rail. The guiding string's traveling direction changes about 90 degrees as it deflects from the string channel to the first hole, and a second time about 90 degrees as it deflects to extend through the string opening. Thus, the guiding string changes its traveling direction twice during its passage through the holes and string openings of one and the same end piece.

A second preferred embodiment for a sunshade of the invention further comprises a second guiding string, said second guiding string being adapted to extend by way of the string channel and the first hole included in an end piece present at a first end of the edge rail, as well as by way of the string opening included in an end piece present at a second end of the edge rail. Hence, in this embodiment, two guiding strings extend into the edge rail through one and the same first hole included in the first end piece. The second guiding string passes by way of two different end pieces, said end pieces being located at opposite ends of the same edge rail. The traveling direction of the guiding strings changes about 90 as it proceeds through the hole or the string opening.

Yet another preferred embodiment for a sunshade of the invention further comprises at least one support string, said support string being adapted to extend by way of the string channel and the first hole of an end piece. Support strings are particularly used in wide sunshades to support and stabilize the sunshade across the area between the guiding strings. In this embodiment, the support string and the guiding strings are extended through an end piece by way of one and the same first hole.

In a still further preferred embodiment for a sunshade of the invention, the protective screen is a folding protective screen. Hence, the sunshade is a so-called pleated blind.

It is an advantage of the invention that it reduces rotation of the sunshade's edge rails around longitudinal axes thereof as the edge rail is moved by manual force. Thereby, the invention improves operation of the sunshade and reduces wear of the guiding strings.

Another advantage of the invention is that it facilitates assembly of the sunshade and reduces the number of separate components needed in the assembly.

BRIEF DESCRIPTION OF THE DRAWINGS

FIG. 1*a* shows by way of example one end piece of the invention for a sunshade's edge rail in an oblique top view from the front, and FIG. 1*b* shows the same end piece in an oblique top view from the rear.

Figure 1A:
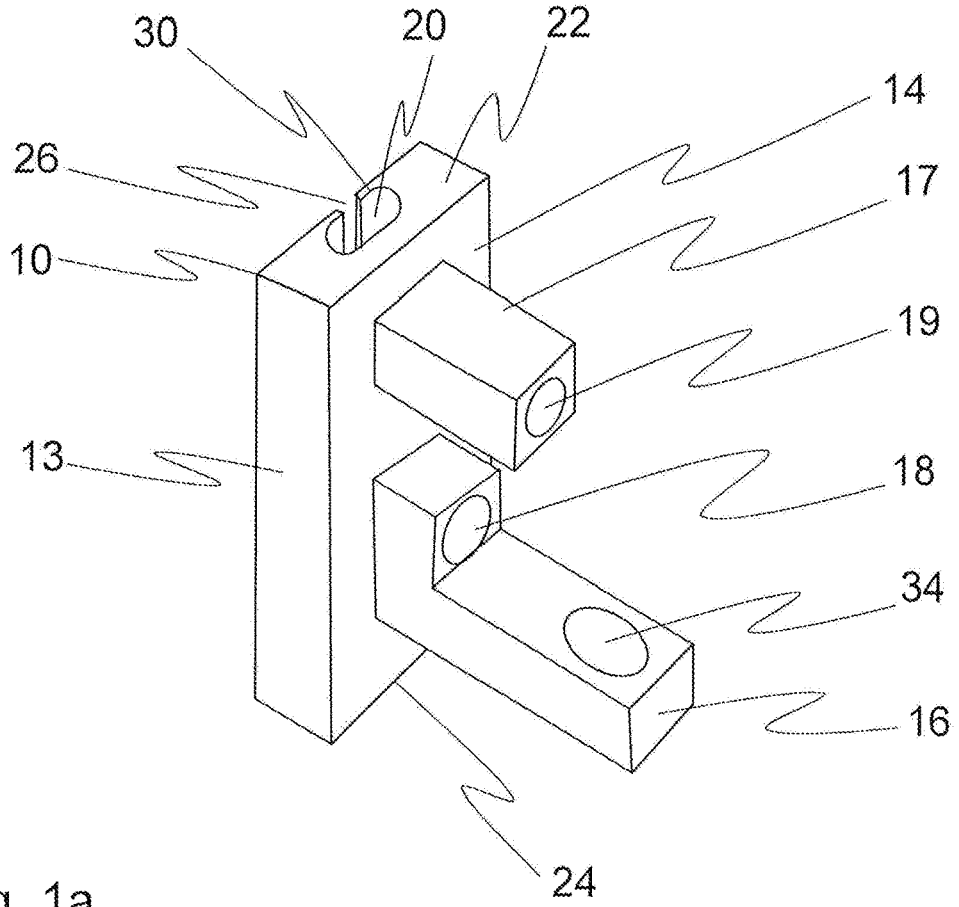
FIGS. 1*a* and 1*b* show by way of example one end piece of the invention for a sunshade's edge rail in views from different directions.

The invention will now be described in detail. In the description, reference is made to the accompanying drawings. Hereinafter, both figures will be described concurrently.

DETAILED DESCRIPTION

The end piece for an edge rail is one-piece component fabricated from a plastic material and provided with an end plate 10. The end plate has a first end surface 12, a second end surface 14, a first side surface 13 and a second side surface 15, as well as a first edge surface 22 and a second edge surface 24. The distance between side surfaces defines a width for the end piece and the end plate, and the distance between edge surfaces defines a height for the end piece and the end plate. The second end surface 14 is provided with two gripping protrusions, a first gripping protrusion 16 and a second gripping protrusion 17. The end piece is intended to be mounted on an end of the sunshade's edge rail in such a way that the second end surface places itself against an end surface of the edge rail. The edge rails of a sunshade are typically hollow aluminum profiles inside which there are lengthwise cavities or channels of the edge rail. The gripping protrusions are dimensioned and the position thereof on the second end surface is determined so as to fit inside the edge rail's cavities or channel tightly or with a small clearance as the piece is mounted to its position on the end of an edge rail. The side surfaces and edge surfaces of an end plate define a cross-sectional shape of the end plate. The shapes of side surfaces and edge surfaces are selected in such a way that the cross-sectional shape of an end plate is substantially identical to that of the sunshade's edge rail on whose end the end piece is to be mounted. The requirements imposed on the cross-sectional shape of an end piece's end plate and on the shape and location of gripping protrusions indicate that it is appropriate to manufacture for different edge rails an individual end piece compatible with a profile shape of the edge rail.

Inside the end piece's end plate 10 is a string channel 20, having its first end opening onto the edge surface 22 and its second end opening onto the edge surface 24. The width of the string channel's cross-section exceeds the depth of its cross-section. In this context, the string channel's width refers to a dimension in the lateral direction of the end plate and the depth refers to a dimension in the direction perpendicular to the first end surface. Between the string channel 20 and the first end surface 12 is a wall 30 provided with a through-going groove 26. The groove extends across the entire height of the end plate, in other words, its first end is at a first end of the string channel and its second end is at a second end of the string channel. The groove has a width which is substantially smaller than that of the string channel. The groove is intended to enable placement of the guiding strings and support strings in the string channel through the wall. Therefore, the groove's width is dimensioned to be substantially equal to the diameter of guiding and support strings typically employed in sunshades.

Within a section between the first and second ends of the groove, the wall 30 has an aperture 32 at which the groove's width locally increases many times over and, in alignment with the aperture, the end plate has a first hole 18. The first hole extends through the end plate and has its first end opening into the string channel 20. A first section of the groove 26 extends in a substantially linear manner from the groove's first end to the aperture and so does a second section of the groove likewise in a substantially linear manner from the aperture to the groove's second end. However, the first and second sections are not co-directional as there is a bend in the traveling direction at the aperture 32. It is by virtue of the bend that the guiding string, presently taut and straight in the string channel, is not able to escape through the groove out of the string channel.

The first gripping protrusion 16 included in the second surface 14 of the end plate 10 has a wider base portion and a narrower tip portion. A second end of the first hole 18 opens onto a surface of the base portion in such a way that a bottom edge of the hole mouth settles substantially flush with a top surface of the tip portion. The first hole has its centerline extending in a direction which is substantially the same as the lengthwise direction of the tip portion. The tip portion is provided with an oval-shaped string opening 34, whose centerline direction is perpendicular to the centerline direction of the first hole and substantially co-directional with the end piece's vertical direction. The first hole and the string opening are constructed in the end pieces for the penetration of guiding strings and support strings included in a sunshade. The sizes for a first hole and a string opening are selected in such a way that a single hole or string opening is able to accommodate the passage of at least two, preferably 2-4, most preferably 3-5, guiding and/or support strings.

The second gripping protrusion 17 included in the second surface 14 of the end plate is located in vertical direction above the first gripping protrusion. Through the second gripping protrusion extends a second hole 19, which is lengthwise of the gripping protrusion and has its first end opening into the string channel and its second end opening onto an end surface of the second gripping protrusion. The second hole enables strings included in a sunshade or its operating mechanism to be guided through the end piece into the interior of an edge rail.

Figure 2:
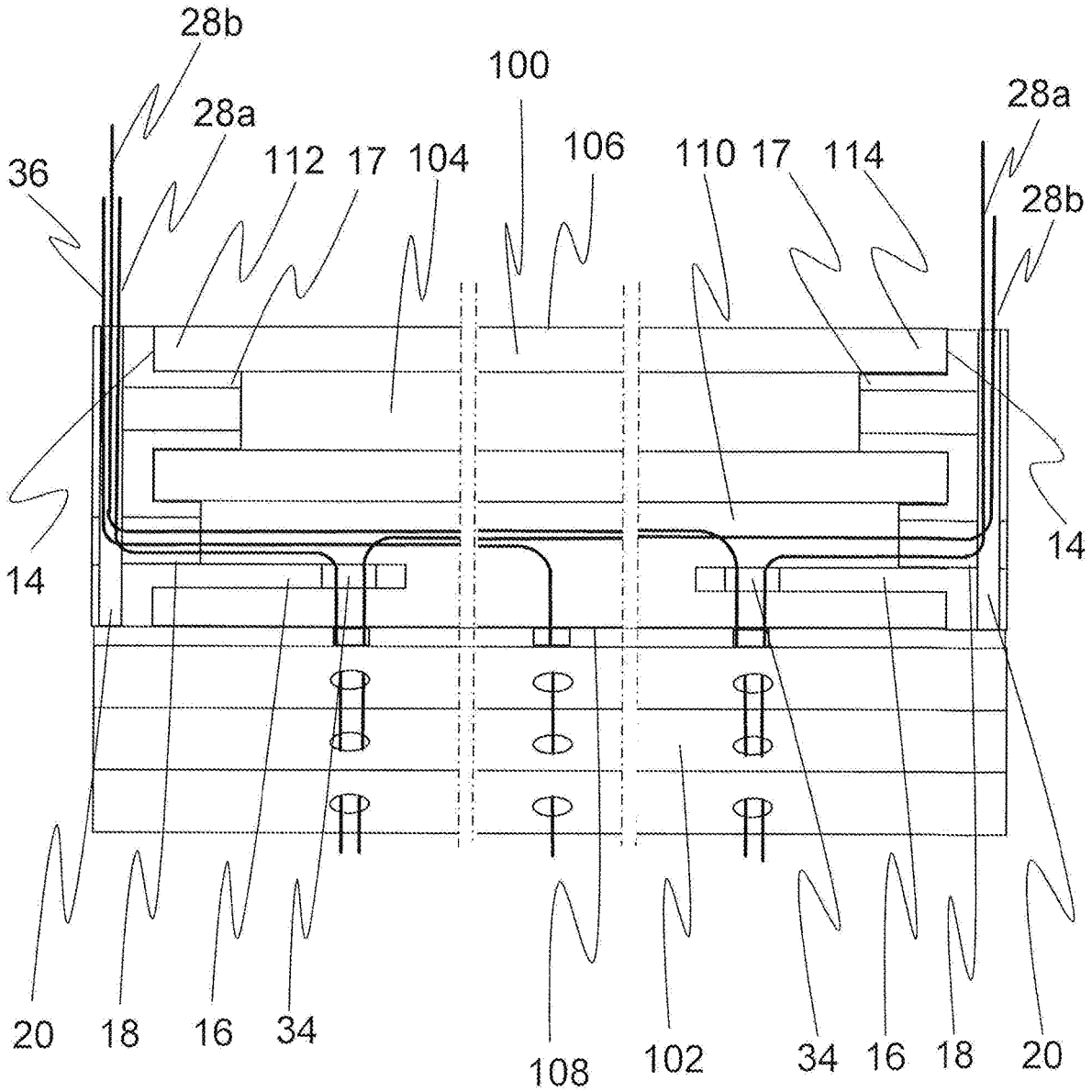
FIG. 2 shows by way of example a part of one sunshade of the invention in a cross-section view.

In FIG. 2 is shown, by way of example, a portion of one sunshade according to the invention in a view from the front. An edge rail 100 included in the sunshade, and end pieces present at the edge rail's ends, are presented in the figure as cross-sectioned in a longitudinal direction of the edge rail.

Figure 1B:
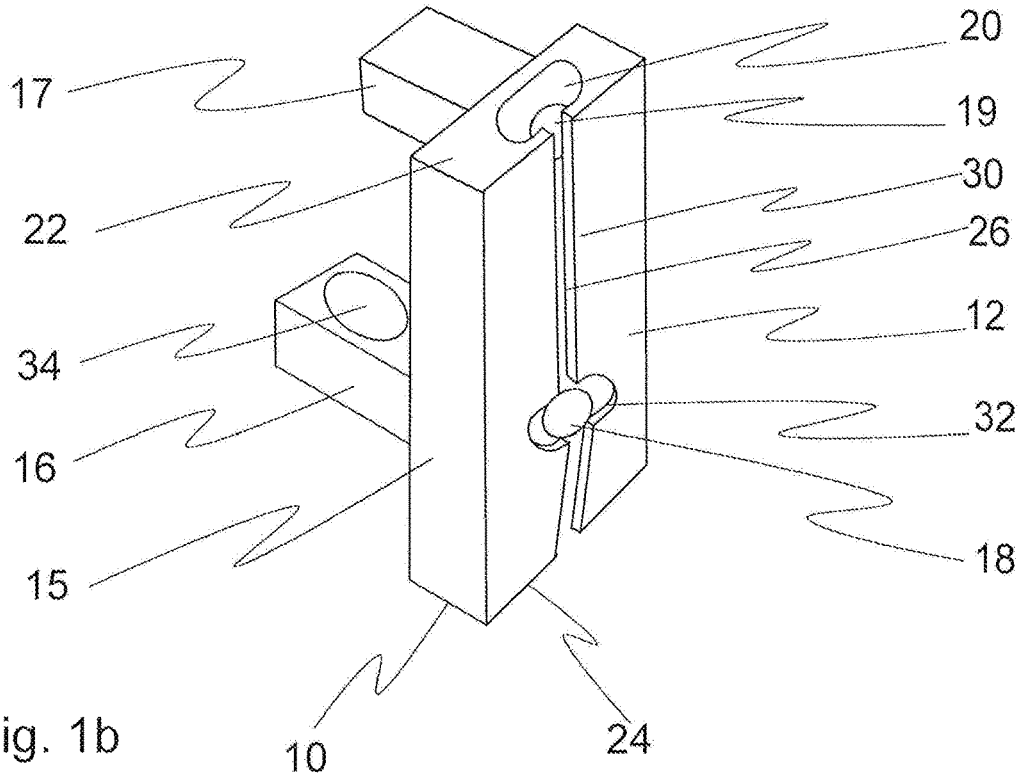

The edge rail is an aluminum profile with a top side 106 and a bottom side 108. Inside the edge profile are two cavities lengthwise of the edge rail, an upper cavity 104 and a lower cavity 110. The lower cavity has in its wall a wall-penetrating slit, which has a length of the entire cavity and which opens onto the bottom side of the edge rail. The edge rail's first end 112 is provided with a first end piece and the edge rail's second end 114 is provided with a second end piece. Both end pieces are identical end pieces as depicted in FIGS. 1*a* and 1*b*. The end pieces are mounted on the ends of an edge rail in such a way that the end piece has its first gripping protrusion 16 positioned in the lower cavity 110, its second gripping protrusion 17 positioned in the upper cavity 104, and the end piece has its second end surface 14 placed against an end surface of the edge rail. The illustrated sunshade is a so-called pleated blind, wherein the part protecting from solar radiation is a folding protective screen 102 constructed from a rigid fabric. The protective screen is fastened by its first edge to the edge rail's bottom side 108. The protective screen has its second edge provided with a second edge rail, which is identical to the first edge rail and fastened to the protective fabric in a similar fashion (the second edge rail is not shown in the figures).

Each edge rail of the sunshade includes two guiding strings; a first guiding string 28*a* and a second guiding string 28*b*. The guiding strings are fastened by the ends thereof to the end or side edges of an opening to be covered, not shown in the figures, in such a way that the guiding strings in an assembled sunshade are in a taut condition. The first guiding string 28*a*, commencing from a first edge of the sunshade, extends along the string channel 20 of an end piece present at a first end 112 of the edge rail to the first hole 18, proceeds by way of the hole into an interior of the edge rail and makes a turn towards the protective screen 102 through a string opening 34 included in the end piece. The first guiding string departs from inside the edge rail by way of a slit included in the lower cavity's wall. After departing from the edge rail, the first guiding string continues its passage through holes in the pleats towards a second edge rail not shown in the figures.

The second guiding string 28*a*, commencing from a first edge of the sunshade, extends along the string channel 20 of an end piece present at a first end 112 of the edge rail to the first hole 18 and through the hole into an interior of the edge rail.

Inside the edge rail, the second guiding string proceeds to the proximity of a second end of the edge rail and makes a turn towards the protective screen 102 through a string opening 34 included the end piece present at a second end 114. The second guiding string departs from inside the edge rail by way of a slit included in the lower cavity's wall and continues its passage through holes in the pleats towards a second edge rail not shown in the figures. The two guiding strings 28*a*, 28*b*, included in a second edge of the sunshade, extend through the end pieces in a similar fashion. When passing through the first hole and the string opening, the traveling directions of guiding strings change by about 90 degrees.

The illustrated sunshade is further provided with a support string 36 bracing the protective screen. The support string extends into an interior of the edge rail along the same path as the guiding strings, in other words, by way of a string channel and a first hole included in the end piece. Inside the edge rail, the support string makes a turn, within a section between the end pieces, towards the protective screen and proceeds through holes in the protective screen's pleats towards a second edge rail not shown in the figures. The sunshade according to the invention can be provided with more than one support string, for example with two or three support strings. The demand for and number of support strings are dependent on the width of a protective screen. In narrow protective screens, support strings are not needed at all. Should the number of support strings be more than one, it is appropriate to conduct the support strings into the interior of an edge rail by way of opposite ends of the edge rail. In the sunshade according to the invention, both the guiding strings and the support strings can be conducted through an end piece into the interior of an edge rail by way of one and the same first hole.

In the foregoing specification there have been described a few preferred embodiments for an end piece and a sunshade of the invention. The invention is not limited to the above-described solutions, but the inventive concept can be applied in various ways within the scope defined by the claims.

The invention claimed is:

1. An end piece for a sunshade's edge rail, said end piece comprising an end plate, said end plate having a first edge surface, a second edge surface, a first end surface and a second end surface to be placed against an end of the edge rail, said second end surface being provided with at least one gripping protrusion adaptable to fit inside the edge rail, and said end plate being provided with a first hole for the penetration of a guiding string, wherein the end piece includes a string channel, said string channel having a width, a first end which opens onto the first edge surface, and a second end which opens onto the second edge surface, and said first hole opens into the string channel, between the string channel and the first end surface is provided a wall, said wall including a through-going groove, said groove having its first end at a first end of the string channel and its second end at a second end of the string channel, and said groove having a width which is substantially less than the width of the string channel, and wherein the wall is provided with a through-going aperture, said aperture having a width exceeding the width of the groove and said aperture being in alignment with the first hole.

2. The end piece according to claim 1 wherein the first hole has a first penetrating direction and the end piece has a first gripping protrusion said first gripping protrusion having a through-going string opening, said string opening having a second penetrating direction, which second penetrating direction is substantially perpendicular to the first penetrating direction and which string opening is located at a distance from the first hole.

3. The end piece according to claim 1, wherein the end plate is further provided with a second hole for the penetration of a string, said second hole opening into the string channel, and the end piece is further provided with a second gripping protrusion, such that the second hole opens alongside or extends through the second gripping protrusion.

4. The end piece according to claim 1, wherein the groove has a section between its first end and its second end provided with at least one bend.

5. The end piece according to claim 4, wherein said bend in the groove is in alignment with the aperture.

6. A sunshade, comprising a first guiding string, a protective screen, said protective screen having an edge, and an edge rail at the edge of the protective screen, said edge rail having a first end and a second end, said ends being provided with an end piece, wherein said end pieces are end pieces according to claim 1.

7. The sunshade according to claim 6, wherein the end piece further comprises a first gripping protrusion, said first gripping protrusion having a through-going string opening and the first guiding string is adapted to extend by way of a string channel, a first hole and the string opening included in an end piece present at a first end of the edge rail.

8. The sunshade according to claim 6, further comprising a second guiding string, said second guiding string being adapted to extend by way of the string channel and the first hole included in an end piece present at a first end of the edge rail, as well as by way of the string opening included in an end piece present at a second end of the edge rail.

9. The sunshade according to claim 6, further comprising at least one support string, said support string being adapted to extend by way of the string channel and the first hole of an end piece.

10. The sunshade according to claim 6, wherein the protective screen is a folding protective screen.

* * * * *